US006057498A

United States Patent [19]

Barney

[11] Patent Number: 6,057,498

[45] Date of Patent: May 2, 2000

[54] VIBRATORY STRING FOR MUSICAL INSTRUMENT

[76] Inventor: Jonathan A. Barney, 312 Signal Rd., Newport Beach, Calif. 92663

[21] Appl. No.: 09/239,234

[22] Filed: Jan. 28, 1999

[51] Int. Cl.[7] ..... G10C 3/08

[52] U.S. Cl. ..... 84/199; 84/297 S

[58] Field of Search ..... 84/297 S, 199

[56] References Cited

U.S. PATENT DOCUMENTS

| | | | |
|---|---|---|---|
| 4,184,405 | 1/1980 | How | 84/297 S |
| 4,197,780 | 4/1980 | Smith | 84/458 |
| 4,281,576 | 8/1981 | Fender | 84/298 |
| 4,453,443 | 6/1984 | Smith | 84/298 |
| 4,833,027 | 5/1989 | Ueba et al. | 428/364 |
| 4,854,213 | 8/1989 | Infeld | 84/297 S |
| 5,095,797 | 3/1992 | Zacaroli | 84/455 |
| 5,341,818 | 8/1994 | Abrams et al. | 128/772 |
| 5,361,667 | 11/1994 | Pritchard | 84/297 R |
| 5,427,008 | 6/1995 | Ueba et al. | 84/297 S |
| 5,578,775 | 11/1996 | Ito | 84/297 S |
| 5,587,541 | 12/1996 | McIntosh et al. | 84/297 S |
| 5,617,377 | 4/1997 | Perret, Jr. | 368/282 |
| 5,637,818 | 6/1997 | Fishman et al. | 84/313 |
| 5,773,737 | 6/1998 | Reyburn | 84/454 |
| 5,859,379 | 1/1999 | Ichikawa | 84/609 |
| 5,913,257 | 6/1999 | Schaller et al. | 84/297 S |

*Primary Examiner*—Robert E. Nappi
*Assistant Examiner*—Shih-yung Hsieh
*Attorney, Agent, or Firm*—Knobbe, Martens, Olson & Bear LLP

[57] ABSTRACT

An improved vibratory string is provided for use in musical instruments such as pianos, guitars, violins and the like. The string is formed from one or more wires of a selected alloy material, such as Ni—Ti alloy, having desired superelastic properties at ambient room temperature. Such a vibratory string tensioned or strained to its superelastic state has improved harmonic and tonal stability characteristics.

33 Claims, 3 Drawing Sheets

VIBRATORY STRING FOR MUSICAL INSTRUMENT

BACKGROUND OF THE INVENTION

1. Field of the Invention

The present invention relates to vibratory strings or music wire for musical instruments such as pianos, guitars, violins and the like, and, in particular, to a novel vibratory string having improved harmonic and tonal stability characteristics.

2. Description of the Related Art

Most music enthusiasts will readily agree that there are few musical experiences more beautiful or fulfilling than listening to music performed on an acoustic instrument such as a grand piano, guitar or violin. The tonal quality, tenor and delicate harmonics of such traditional acoustic instruments have been unsurpassed even by the recent advent of modern digital/electronic sampling and reproduction techniques. However, as improvements and advancements in electronic sound reproduction continue, more and more musicians and music hobbyist are choosing to purchase and play digital electronic keyboard instruments rather than their acoustical piano counterparts.

In part, this shift in consumer preferences can be attributed to the relative inexpense of such electronic instruments, the diversity of sound reproduction and amplification achieved and the ready portability of such instruments. However, another important consideration is that electronic instruments, unlike their acoustic counterparts, generally do not require periodic tuning and maintenance. Anyone who has owned or played an acoustic piano knows that the piano must be periodically tuned by a skilled piano technician in order to keep it in optimal playing condition.

A typical grand piano includes a plurality of longitudinally arranged vibratory strings or wires of varying length overlying a plurality of hammers. The number of strings per note will vary, depending upon the desired pitch of the note, i.e., typically one string per note in the lower octaves and two or three strings per note in the mid and upper octaves. Each string is vibrationally fixed or grounded at one end by a hitch pin located on the bowed portion of the piano harp and, at the other end, by an adjustable tuning pin frictionally and rotatably retained in a tuning ("pin") block. The strings are placed under tension by turning or adjusting the tuning pin so that when a string (or strings) is struck by an associated hammer the string is set into mechanical vibration whereby a sound having a particular desired pitch is produced. The pitch of the sound produced depends largely upon the active length of the string, its weight or mass and the amount of tension applied. Thus, the shorter, smaller diameter strings located at the treble end of a piano typically produce a relatively high pitched sound whereas the longer, larger diameter strings disposed at the bass end of the keyboard produce a much lower pitched sound.

A sound board, typically formed from laminated or glued strips of a light hardwood such as spruce, is disposed underneath the vibratory strings in order to acoustically amplify the vibrations of the activated string or strings into audible sound. The sound board includes one or more bridges, typically of hard rock maple, on which each string bears down. The distance between the bridge and the tuning pin defines the active length of the string. The sound board is typically crowned such that it bows slightly upward pressing the bridge (or bridges) into the taught strings. This configuration has been demonstrated to improve the acoustic qualities of the piano and also helps the sounding board support the immense downward pressure brought to bear against it by the tensioned strings. Because the amount of the required tension can easily attain 100 kg. (220 pounds) or more per string and because many such strings are required to construct a piano of adequate tonal range, most pianos are provided with very sturdy frames and supports to support and secure such strings. Modern grand pianos utilize a heavy cast iron frame or harp so that heavier strings can be used at higher tensions to produce a fuller and richer piano sound.

In addition to the length and diameter of string involved, the tonal qualities of the sound produced when striking a particular string are also dependent upon a number of other factors. These include the particular mechanical properties of the material or materials comprising the string, such as ductility, tensile strength, elasticity and density per unit length. These properties can effect the tonal quality, tenor and dwell of a particular note played, as well as the occurrence or selected amplification or attenuation of various harmonic partials.

A "partial" is a component of a sound sensation which may be distinguished as a simple sound that cannot be further analyzed by the ear and which contributes to the overall character of the complex tone or complex sound comprising the note. The fundamental frequency of the string is the frequency of the first partial, or that frequency caused by the piano string vibrating in the first mode, or the lowest natural frequency of free vibration of the string. A harmonic is a partial whose frequency is usually an integer multiple (eg., n=1, 2, 3 . . . ) of the frequency of the first partial or fundamental frequency of the string.

As noted above, strings for musical instruments are required to keep strong tension and a high degree of stability for a long period of time due to the nature of strings being strung and then tuned. Strings which plastically deform or stretch by bowing, plucking or striking are typically not used on musical instruments because they typically lack sufficient elastic compliance to sustain vibratory motion for any useful period of time and can also deform or permanently stretch if struck or plucked to hard. Conventional vibratory strings used on musical instruments are typically made of materials having a high elastic modulus such as carbon steel wire, stainless steel wire, phosphor bronze wire, synthetic resin, sheep gut, etc. For pianos and guitars, often a carbon steel wire core having a diameter of about 0.090 inches will be wound with annealed copper wire or other precious or semi-precious metals in order to change the density per unit length of the string and to enable optimal adjustment of sound quality, attenuation rate and selection of the basic vibration frequency. Thus, U.S. Pat. No. 5,578,775 to Ito describes a vibratory string for use on musical instruments comprising a core wire composed of long filaments of steel wire, sheathed with a thick mantle of a precious metal such as gold, silver, platinum, palladium, copper, or the like. U.S. Pat. No. 3,753,797 to Fukuda describes an improved string for a stringed instrument comprising carbon steel wire electrically heat treated under tensile stress to reduce residual stress in the string and thereby minimize tonal variation over long periods of time after the string has been strung in the instrument.

Notwithstanding the significant improvements in vibratory strings over the years, it is well know that even a very small change in the stretch or amount of tension on a conventional vibratory string can result in a significant detuning of the string. Such changes may result from, inter alia, environmental conditions, such as temperature, humidity and the like, which cause portions of the sound board, bridge and/or harp to expand or contract and thereby alter the string length/tension. These changes can cause the piano or other string instrument to produce a less than optimum sound, especially if a rather large change is experienced. Also, during the initial tuning of the piano by factory personnel, the tensioning or de-tensioning of the various strings can cause similar changes in the shape of the sound board, bridge and/or harp, particularly the degree of crowning of the sound board. The latter is directly affected by the total amount of downward pressure exerted on the sound board by the strings under tension. Thus, repeated iterative tuning at the factory over the course of several days or weeks is often necessary to achieve a desired stable tonal range.

Even after a piano is put into service, periodic adjustment and maintenance by a skilled piano technician is required to keep the strings optimally tuned. This is typically effected by turning the various tuning pins, either tightening or loosening each associated string. Repeated adjustment of the tuning pins over years of use tends to adversely affect the tuning pins and/or the tuning block in which they are frictionally retained. As a result, the pin block of an older piano will often become so worn by repeated tunings that the tuning pins no longer have sufficient frictional engagement with the pin block to prevent them from rotating under the residual stress of the tuned string. In such case the piano will not be able to hold its tune for prolonged periods and must either be tuned much more frequently or the pin block must be repaired or replaced.

Furthermore, those skilled in the art will appreciate that when a vibratory string is struck, plucked, bowed or otherwise excited, the transient vibratory displacement (and, therefore, stretching) of the string itself can effectively increase the natural pitch of the string for higher harmonic partials. This is because as the string vibrates at the fundamental and lower harmonics it must necessarily increase its length by periodically stretching and contracting as the string moves back and forth during the resultant transient decay. Effectively, this increases the tension on the string and, therefore, undesirably increases the pitch of higher harmonic partials. Thus, these higher harmonic partials can actually vibrate in disharmony with the fundamental and lower harmonic partials, causing unpleasant overtones, particularly in the seventh, ninth and higher harmonics.

Conventionally, piano manufacturers have attempted to compensate for these unpleasant overtones by carefully selecting the strike point of the hammer so that it falls on or near a node of the partial harmonic(s) desired to be attenuated. See, for example, U.S. Pat. No. 4,244,268 to Barham. However, such approaches have been unsuccessful in removing all of the undesired disharmonic overtones. Rather, they are only compromise approaches which attempt to attenuate as much as possible those disharmonic overtones that the human car finds most unpleasant.

SUMMARY OF THE INVENTION

Accordingly, it is a principle object and advantage of the present invention to overcome some or all of these limitations and to provide a vibratory string for a musical instrument having improved harmonic and tonal stability characteristics.

In accordance with one embodiment the present invention provides a vibratory string for musical instruments comprising a core formed of one or more filaments or wires of an alloy material selected to have superelastic properties at or about room temperature. The core is impregnated, coated or wound with a second material comprising a precious or semiprecious metal, such as copper, gold, or silver or an alloy thereof.

In accordance with another embodiment the present invention provides a musically tuned vibratory string comprising one or more filaments or wires of an alloy material selected to have superelastic properties at or about room temperature. The vibratory string is secured and supported so as to have an active length thereof capable of sustained vibration. The vibratory string is tensioned or strained to its superelastic state whereby a musical tone may be generated. In a further preferred embodiment the musically tuned vibratory string comprises a Ni—Ti alloy wire having a characteristic thermoelastic martensitic phase transformation at a transformation temperature (TT). The string is tensioned or strained to the point of causing at least some stress-induced crystalline transformation from an austenitic crystalline structure to a martensitic crystalline structure.

In accordance with another embodiment the present invention provides a musical instrument strung with one or more vibratory strings comprising a wire formed of an alloy material selected to have superelastic properties at or about room temperature. Optionally, the vibratory strings may be tensioned or strained to their superelastic condition. In a further preferred embodiment, at least one of the vibratory strings comprises a Ni—Ti alloy comprising, for example, between about 49.0 to 49.4% Ti and having a characteristic thermoplastic martensitic phase transformation at a transformation temperature (TT) and the string is tensioned or strained to the point of causing stress-induced crystalline transformation from an austenitic crystalline structure to a martensitic crystalline structure.

In accordance with another embodiment the present invention provides a method for stringing a stringed musical instrument. A vibratory string is selected comprising one or more wires formed of an alloy material having superelastic properties at or about room temperature. A first end of the string is then secured to the instrument. A second end of the string is then also secured to the instrument and the string is supported on the instrument so as to provide an active length thereof capable of sustained vibration. Finally, the string is tensioned or strained to its superelastic state. In a further preferred method, the vibratory string is selected to comprise a Ni—Ti alloy having a characteristic thermoelastic martensitic phase transformation at a transformation temperature (TT) at or below room temperature and the string is tensioned or strained to the point of causing stress-induced crystalline transformation from an austenitic crystalline structure to a martensitic crystalline structure. In yet a further preferred method, the vibratory string is selected to comprise a Ni—Ti alloy having a transformation temperature (TT) between about 15° C. and −100° C.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
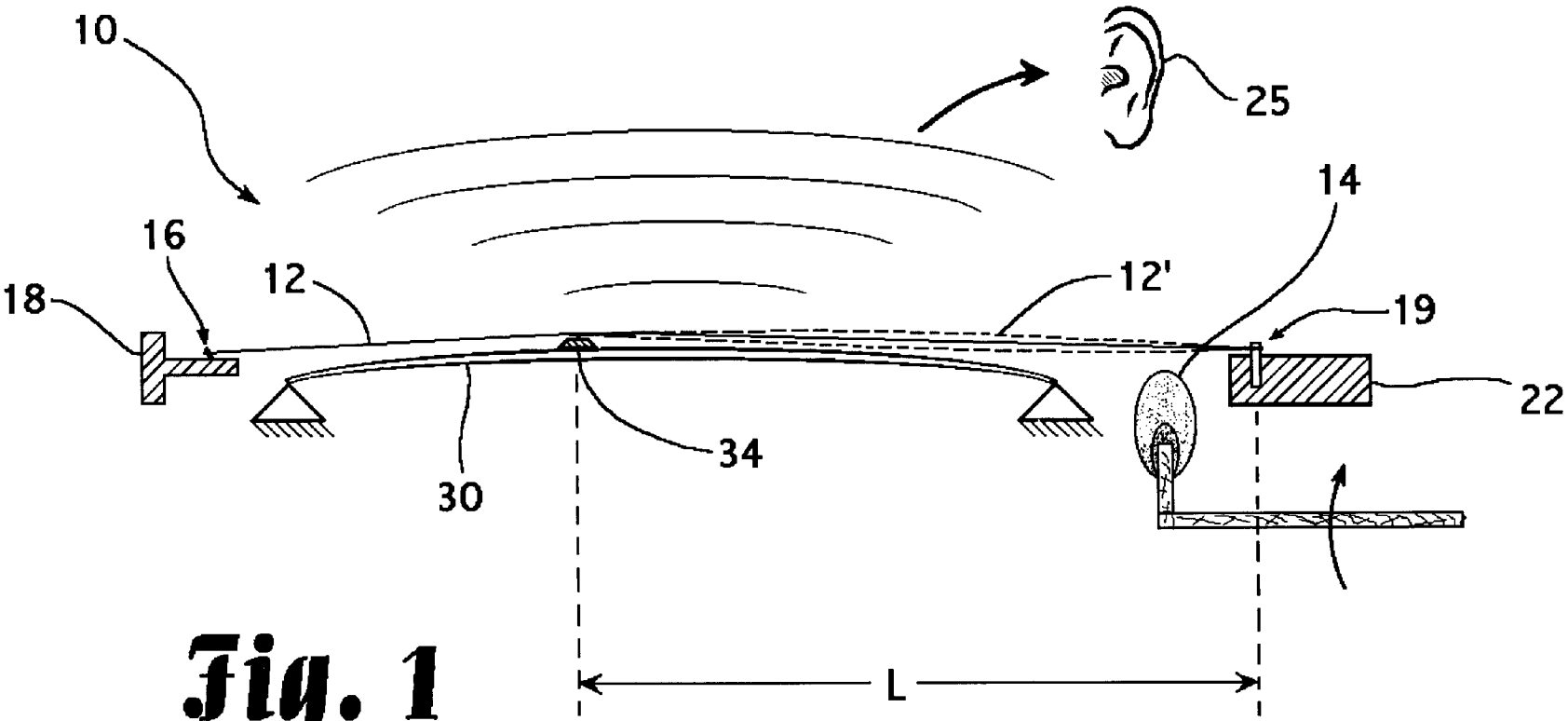
FIG. 1 is a schematic diagram illustrating the basic construction and operation of a conventional acoustic piano.

FIG. 1 is a schematic drawing illustrating the basic construction and operation of the inner workings 10 of a conventional acoustic piano. For convenience and ease of description only one note-producing clement is shown and described. However, those skilled in the art will readily appreciate that a plurality of such note producing elements (usually 88) are provided in a typical piano and all are constructed and operate in a similar manner.

Referring to FIG. 1, it will be understood that a plurality of longitudinally arranged vibratory strings or wires 12 of varying length are provided overlying a plurality of hammers 14. The number of strings per note will vary, depending upon the desired pitch of the note, i.e., typically one string per note in the lower octaves and two or three strings per note in the mid and upper octaves. Each string is vibrationally fixed or grounded at one end by a hitch pin 16 located on a portion of the piano harp 18 (shown here in cross section) and, at the other end, by an adjustable tuning pin 19 frictionally and rotatably retained in a tuning block or "pin block" 22. The string 12 is placed under tension by turning or adjusting the tuning pin 19, thereby winding the string 12 partially onto the pin 19.

A sound board 30, typically formed from laminated or glued strips of a light hardwood such as spruce, is disposed underneath the vibratory strings 12 in order to acoustically amplify the vibrations of the activated string or strings 12 into audible sound. The sound board includes one or more bridges 34, typically of hard rock maple, on which each string 12 under tension bears down. The distance between the bridge and the tuning pin defines the active length "1" of the string. The sound board 30 is typically crowned, as shown, such that it bows slightly upward pressing the bridge (or bridges) 34 into the taught strings 12. This configuration has been demonstrated to improve the acoustic qualities of the piano and also helps the sounding board 30 support the immense downward pressure brought to bear against it by the tensioned strings 12.

When the tensioned string (or strings) 12 is struck by the associated hammer 14 the string 12 is set into mechanical vibration (indicated by dashed lines 12'). This vibrational energy is transmitted through the bridge 34 to the sound board 30 whereby a sound having a particular desired pitch is produced that can be audibly detected by the human ear 25. The pitch of the sound produced depends largely upon the active length "1" of the string 12, its weight or mass and the amount of tension applied. Thus, the shorter, smaller diameter strings located at the treble end of a piano typically produce a relatively high pitched sound whereas the longer, larger diameter strings disposed at the bass end of the keyboard produce a much lower pitched sound. Conventional vibratory strings for pianos and similar instruments are made of carbon steel wire, stainless steel wire, phosphor bronze wire or other similar wire material having high strength and high modulus of elasticity.

Figure 2:
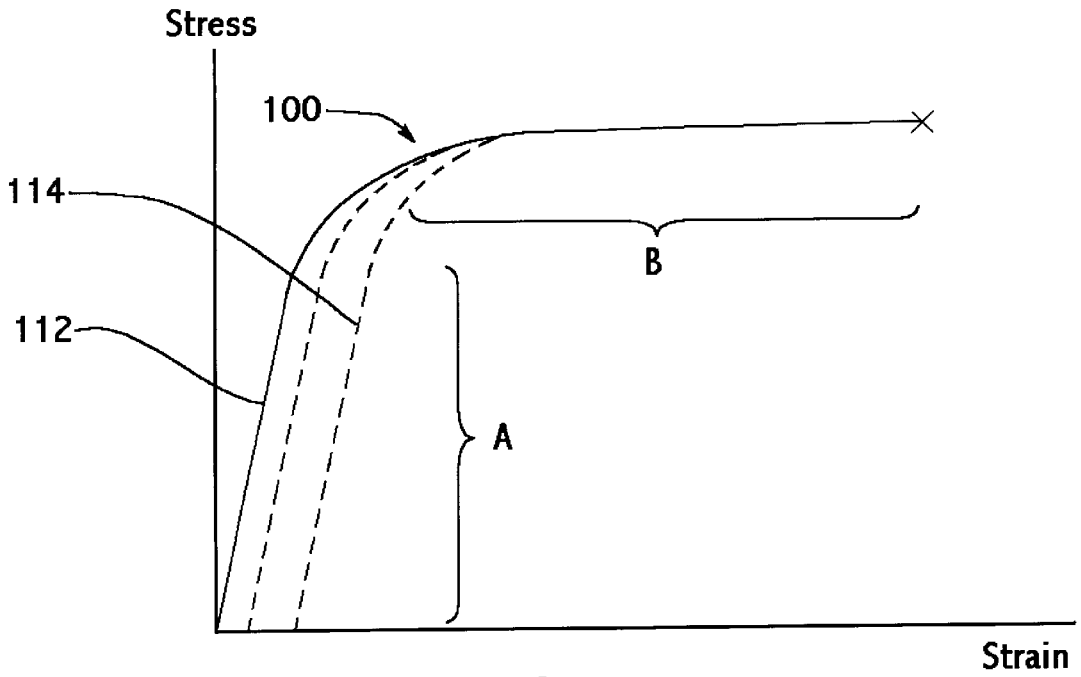
FIG. 2 is a typical stress-strain curve for a vibratory string comprising conventional steel piano wire.

FIG. 2 is a stress-strain diagram illustrating the tensile response characteristic of a typical steel piano wire. The stress-strain curve 100 may aptly be characterized as having two distinct regions "A" and "B", as indicted. The region "A" is characterized by elastic strain whereby the steel wire experiences stress-induced elongation that does not permanently deform the steel wire and, therefore, is fully reversible or recoverable once the stress is relieved. The stress-strain curve is generally linear in this region such that stress (and, therefore, wire tension) is roughly proportional to the amount of strain. The slope of the curve in the elastic region "A" is equal to Young's modulus, or the modulus of elasticity for the material. This is the desired range for tensioning a conventional steel piano wire.

The region "B" is characterized by plastic strain whereby the steel wire experiences stress-induced elongation and permanent deformation that is not fully recoverable. The dashed lines 112, 114 indicate typical elongation recovery curves following varying degrees of plastic strain. The curves 112 and 114 are shifted to the right indicating permanent elongation of the wire after the applied stress is relieved.

Importantly, FIG. 1 also illustrates an inherent characteristic and limitation of conventional steel piano wire. In particular, persons skilled in the art will readily appreciate that within the elastic range "A" even a relatively small change in the amount of strain, such as may be caused by environmentally-induced changes or expansion or contraction of the surrounding support structure, can cause a relatively large change in the amount of stress (tension) experienced by the wire and, thus, the fundamental harmonic of the vibratory string or wire. This is because the material has a relatively high modulus of elasticity (~205 GPa) and a steep linear yield curve in the elastic Region "A". The degree and frequency that such changes are experienced will dictate how often the string tension must be readjusted by a skilled technician to maintain the instrument in optimal playing condition.

While it is not directly illustrated in FIG. 1 it also bears mentioning that other factors can have a similar detuning effect on a tensioned string. Such factors may include, for example, temperature-induced expansion or contraction of the wire itself, plastic creep caused by prolonged stress, and even changes in the mass and/or density of the wire due to corrosion or accumulation of dirt, oil or other deleterious contaminants. However, changes in the surrounding support structure, and particularly changes in the shape of the sound board and bridge, are believed to be a large, if not the dominant, factor accounting for detuning of a piano over time.

In accordance with one embodiment of the present invention an improved vibratory string for musical instruments is provided comprising one or more wires formed from an alloy of titanium and nickel (Ni—Ti), commonly known in the metal supply industry as Nitinol™ wire. Such materials may be obtained from any one of a number of supplier/fabricators including Memory Corporation™ and Raytheon Corporation™. In the preferred embodiment a commercially available alloy comprising approximately equal parts nickel and titanium was selected. Wire formed from such alloy in various diameters may be obtained from Memory Corporation under the specified alloy name "Nitinol BA".

For purposes of conducting initial experimentation a wire diameter of 0.015 inches was selected. However, it will be readily apparent to those skilled in the art that the particular wire diameter may vary over a wide range, depending upon the nature of the instrument to be strung, the desired pitch and the active length of the wire. Also, it will be readily apparent to those skilled in the art that multiple filaments of such wire may be bundled or braided together and used as a single vibratory string, if desired. In either case, the wire or wire bundle may also be coated or impregnated with a suitable binder or protective covering, as desired, and/or may be wound with copper or other suitable materials as is know in the art to achieve a desired density per unit length of the active string length. This enables optimal adjustment of sound quality, attenuation rate and selection of the basic vibration frequency.

In general, such alloy compositions of nickel (Ni) and titanium (Ti), produce stable and useful alloys having a relatively low modulus of elasticity (~83 GPa) over a wide range, a relatively high yield strength (~195–690 MPa), and the unique and unusual property of being "superelastic" over a limited temperature range. Superelasticity refers to the highly exaggerated elasticity, or spring-back, observed in many Ni—Ti and other superelastic alloys over a limited temperature range. Such alloys can deliver over 15 times the elastic motion of a spring steel, i.e., withstand a force up to 15 times greater without permanent deformation. The particular physical and other properties of Nitinol alloys may be varied over a wide range by adjusting the precise Ni/Ti ratio used. Generally, useful alloys with 49.0 to 50.7 atomic % of Ti are commercially available, but alloys in the range of 49.0 to 49.4% Ti are most preferred for purposes of practicing the present invention. Special annealing processes, heat treatments and/or the addition of trace elements, such as oxygen (O), nitrogen (N), iron (Fe), aluminum (Al), chromium (Cr), cobalt (Co) vanadium (V), zirconium (Zr) and copper (Cu), can also have very significant effects on desired superelastic properties and performance of the materials. See, for example, U.S. Pat. No. 5,843,244 to Pelton. Of course, the invention disclosed herein is not limited specifically to Ni—Ti alloys, but may be practiced using any one of a number of other suitable alloy materials having the desired superelastic properties, such as Silver-Cadmium (Ag—Cd), Gold-Cadmium (Au—Cd) and Iron-Platinum (Fe3Pt), to name but a few.

The actual mechanics of superelasticity on a microcrystalline level have been studied and reported extensively in the literature, particularly binary alloys of nickel and titanium. See, for example, *Structure and Properties of Ti—NI Alloys: Nitinol Devices & Components,* Duerig et al., Titanium Handbook, ASM (1994). For purposes of this disclosure and for understanding and practicing the invention, however, it is not particularly important that these aspects be explained or understood. A very brief explanation of the crystalline structure and operation of a typical superelastic alloy material is provided below for purposes of general background understanding and assisting those skilled in the art in selecting suitable materials for carrying out the invention.

Most superelastic alloys, such as Ni—Ti, display a characteristic thermoelastic martensitic phase transformation and a Transformation Temperature (TT), which is specific to each alloy and each alloy possesses unique mechanical and transformation properties. As these alloys are cooled through their TT, they transform from the higher temperature austenite phase to the lower temperature martensite phase. The physical properties of these materials also change significantly as their respective TTs are approached. In general, at lower temperatures, these alloys will exist in a martensite state characterized as weak and easily deformable. However, in the austenite state, the high temperature phase, the alloys become strong and resilient with a much higher yield strength and modulus of elasticity.

Superelasticity in Ni—Ti alloys derives from the fact that the alloy, if deformed at a temperature above its transformation temperature, is able to undergo a stress-induced shift from its strong austenite crystalline structure to the relatively weak and compliant martensite crystalline structure. However, because such stress-induced formation of martensite occurs above the alloy's normal transformation temperature, it immediately and completely reverts to its undeformed austenite state as soon as the stress is removed. As a result of this fully reversible stress-induced crystalline transformation process a very springy or rubber-like elasticity ("superelasticity") is provided in such alloys. However, the desired superelastic property is usually only obtainable when the alloy is maintained at or above its transformation temperature. For that reason, and for purposes of practicing the invention it is generally desirable to select a superelastic alloy having a relatively low transformation temperature. Preferably the transformation temperature is selected to be at least below normal room temperature of about 25° C. and is most preferably selected to be between about 15° C. and −200° C.

Figure 3:
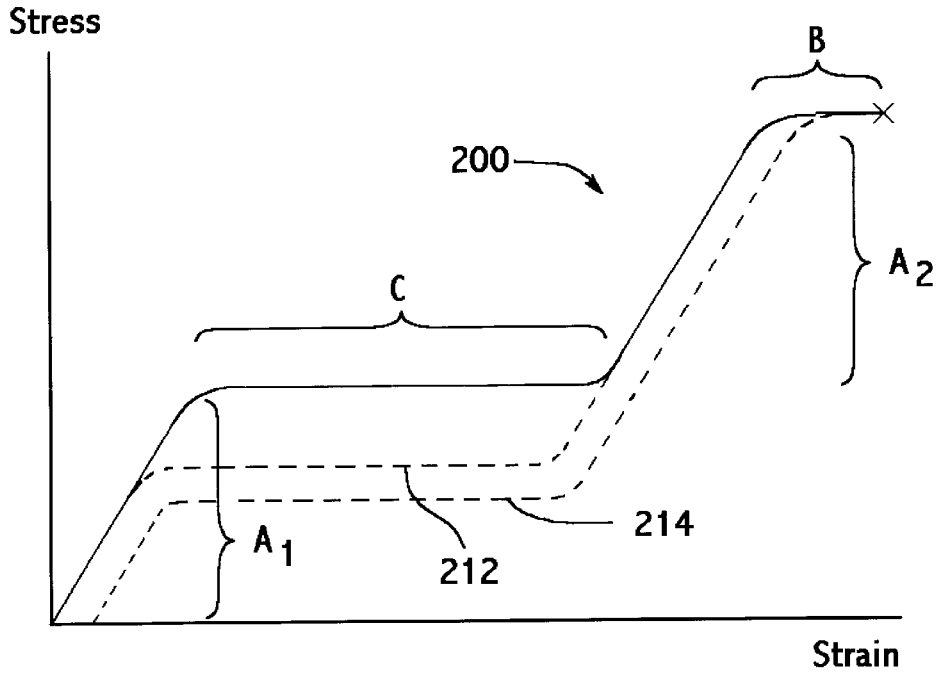
FIG. 3 is a typical stress-strain curve for a vibratory string comprising wire formed of a superelastic alloy in accordance with one embodiment of the present invention.

FIG. 3 is a stress-strain diagram illustrating the tensile response characteristic of a wire formed from a superelastic alloy such as Nitinol™. In this case, the stress-strain curve 200 has two elastic regions generally denoted "$A_1$" and "$A_2$" wherein the wire experiences reversible stress-induced elongation and wherein the amount of strain is generally proportional to the amount of stress (tension) applied in accordance with the modulus of elasticity of the material in those regions. The stress-strain curve 200 also illustrates that the wire undergoes plastic or permanent deformation in the region "B" wherein the wire experiences stress-induced elongation and permanent deformation that is not fully recoverable, as illustrated by the elongation recovery line 214. The curve also illustrates the unique superelastic region "C" wherein the wire experiences reversible elongation over a range of constant or substantially constant stress (tension). Elongation recovery line 212 illustrates that the stress-induced elongation is fully recoverable so that no appreciable permanent deformation or elongation of the wire is experienced over the region "C". The elongation recovery in the superelastic region "C" does exhibit some hysteresis effect, as illustrated in FIG. 3, and thus some energy loss. However, it has been determined experimentally that such hysteresis effect does not significantly dampen or inhibit the free harmonic response of a wire that is strained or tensioned to its superelastic state, generally defined by the superelastic region "C".

Desirably, a vibratory string formed of such wire (or wires) may be suitably tuned and tensioned to be generally within the middle of superelastic range "C." Those skilled in the art will recognize that the fundamental harmonic frequency of such wire strained or tensioned in such manner will be relatively unaffected by gradual or even abrupt changes in the amount of elongation strain, such as may be caused by the aforementioned environmentally-induced changes in the surrounding support structures, etc. This is because, in accordance with the stress-strain curve 200 illustrated in FIG. 3, the amount of stress (tension) on the wire remains generally constant throughout the superelastic region "C" within a limited temperature range. As a result, those skilled in the art will readily appreciate that an instrument, such as a piano, strung with vibratory strings comprising superelastic alloy wires tensioned or strained in accordance with the invention can hold its tune much longer and require much less frequent tunings to maintain the instrument in its optimal playing condition.

Experiments have also revealed, surprisingly, that a vibratory string comprising a superelastic alloy wire in accordance with the invention and tensioned or strained to be within the superelastic range "C" produces, when suitably struck or plucked, a superior and exceptionally harmonic and resonant tone with little or no undesired overtones. The exact explanation for the superior tonal qualities is not completely understood. There are many factors, many unknown, which influence the particular tonal quality of sound produced by a vibratory string. However, it is believed that the wire being composed of a superelastic alloy and tensioned or strained to be within the superelastic range "C" as described above eliminates or avoids the aforementioned problem of detuning of higher harmonic partials caused by transient vibratory displacement and stretching of the string itself. In accordance with the present invention the vibratory string itself can stretch without appreciably changing its tension and, therefore, without increasing the pitch of higher harmonic partials. Thus, it is believed that all such higher partials vibrate in harmony with the fundamental and lower partials such that the overall tone is harmonic and pleasing to the ear.

Experiments have further revealed that unique and pleasant tones may also be produced when a vibratory string comprising superelastic Ni—Ti alloy wire in accordance with the invention is tensioned or strained to be within either the elastic regions $A_1$ or $A_2$ and suitably struck or plucked. This is believed to be a result of the unique elasticity and vibrational properties of the material in these regions, generally characterized by a relatively low modulus of elasticity (~83 GPa versus ~205 GPa for steel wire) and a relatively low density (6.45 g/cm$^3$ versus 7.85 g/cm$^3$ for steel wire).

The selected tuning of vibratory strings formed of a superelastic alloy and tensioned or strained to be within the superelastic region "C" poses additional considerations which merit particular discussion. As noted above, when such a wire is tensioned or trained to be within the superelastic region "C" the tension experienced by the wire remains relatively constant as the superelastic material undergoes a progressive transformation from its austenite crystalline state to its martensite crystalline state. Thus, the tension of the wire cannot be readily adjusted by turning a conventional tuning pin to wind the string onto the pin. However, it has been discovered that tuning using a conventional tuning pin can accomplish tuning within a limited range. Such limited tuning is believed to be facilitated by the actual stretching of the wire itself (without increasing its tension) and the concomitant reduction in its density per unit length. Thus, the fundamental pitch of a vibratory string formed of a superelastic alloy and tensioned or strained to be within the superelastic region "C" can be tuned within a limited range using a conventional tuning pin, perhaps modified to accommodate larger expected elongation strains. Additional tuning, if needed, can be effected by adjusting or repositioning the bridge to shorten or lengthen the active length of the vibratory string. If the vibratory string is to be used in the elastic regions $A_1$ or $A_2$ illustrated in FIG. 3 a conventional or modified tuning pin should be suitable to accomplish a reasonable range of tuning. Of course, such vibratory strings can also be tuned as is well known in the art by selecting appropriate diameter wire and/or by coating or winding the wire with other materials such as copper, gold or silver to obtain a desired density per unit length.

Alternatively, and in accordance with another preferred embodiment of the present invention the vibratory string may comprise a plurality of wires or filaments bundled or braided together wherein at least one or more of the wires or filaments is formed of a material having a substantially linear elastic compliance characteristic. In this manner, the overall tension of the string will be equal to the sum of the multiple tension components attributable to each individual wire or filament. Accordingly, such a vibratory string will exhibit desirable characteristics of both a superelastic alloy in its superelastic state as well as desirable characteristics of a conventional linear elastic material in the elastic compliance region. More specifically, the vibratory string when tensioned or strained to the superelastic state, would continue to increase its tension (albeit at a slower rate) as it is further strained. This would facilitate a wider range of tuning ability using a conventional tuning pin, while still preserving many of the advantages heretofore discussed. Similarly, a multi-wire or multi-filament vibratory string may be formed from two or more different wires or filaments of superelastic alloy materials, having different stress/strain compliance characteristics, in order to provide a gently upward sloping stress-strain compliance characteristic in the resultant string when tensioned or strained to the superelastic state. This is in contrast to the essentially flat or constant stress compliance characteristic illustrated in the region "C" of FIG. 3.

In the preferred embodiment described above, it was mentioned that the tonal stability of the tensioned vibratory string is provided only over a limited temperature range. This is due the highly temperature-dependent nature of the Ni—Ti alloy wire used in the above examples. Thus, to achieve optimal tonal stability using vibratory strings composed of a Ni—Ti alloy wire it is desirable to select an alloy having relatively stable elastic and/or superelastic properties within the desired temperature range (for example within about ±5° C. of normal ambient room temperature). Ni—Ti alloys having very low transition temperatures (between about −100° C. and −200° C.) are believed to provide the best temperature stability in the superelastic state at room temperatures at or around 25° C.

Alternatively, or in addition, the temperature of the vibratory strings can be directly or indirectly controlled so as to provide even more tonal stability. This may be accomplished, for example, using any one of a number of known temperature control techniques, such as ambient heating/cooling of an indoor environment where the instrument resides and/or by temperature regulation of the inner case of the musical instrument itself using a suitable heat source such as an electric resistance heater. Such heaters for acoustic pianos are well known and commercially available from any one of a number of sources.

Figure 4:
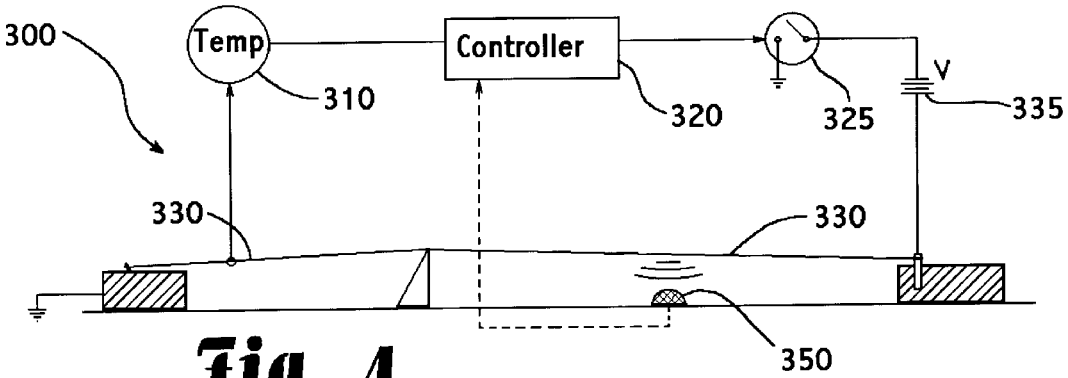
FIG. 4 is a schematic diagram illustrating a string temperature sensing and control system having features in accordance with the present invention.

Alternatively, if more precise temperature control is desired an electrical current may be selectively passed through each vibratory string, either individually in succession by means of a suitable current or voltage source and an electronic switch or variable impedance device(s), or in parallel using a voltage or current source and one or more suitable resistive ballast elements or variable impedance devices, or some combination of these techniques. Accordingly, each wire is heated due to its electrical resistance to the current. If desired, closed-loop control may be provided, as illustrated in FIG. 4, by temperature sensing and feedback using a suitable temperature sensing element 310 (eg., a thermal-couple, thermal-resistive element, or infrared sensor) and control circuitry 320 (eg., a suitably programmed micro-computer chip or CPU) to selectively apply current or voltage from a source 335 to a string 330 via an electronic switch or variable impedance 325. Such closed-loop temperature sensing and control system 300 can regulate the ambient temperature within the musical instrument, for example, or it can regulate the temperature of each vibratory string 330 individually, as desired. Simple passive control systems can also be implemented to the same effect using known mechanical and/or electrical sensing and control elements.

Even more sophisticated active or passive control systems can be implemented, if desired, to provide optimal tonal stability of an acoustic instrument. For example, a closed-loop feedback control circuit can be readily implemented using well-known sensing and control techniques to periodically sense or measure the fundamental harmonic of each vibratory string 330, such as via a piezoelectric sensor or microphone 350 and adjust the temperature of the string 330 by heating or cooling to raise or lower the fundamental harmonic to the desired pitch. Alternatively, such control system may similarly adjust the pitch of each vibratory string by automatically adjusting the tension or active length of the string using a suitable mechanical transducer.

Those skilled in the art will further recognize that many of the above-described examples and techniques may be advantageously implemented in acoustic instruments strung with conventional vibratory strings, such as carbon steel wire. These may be used, for example, if the overall tone and quality of a conventional steel wire is desired. Thus the examples and techniques described above may be used to achieve more accurate and/or stable tension or tonal regulation.

It is also possible to combine the benefits of conventional music wire with wire formed from a superelastic alloy by splicing or joining together two lengths of such wires to form a single vibratory string. In such case, preferably the splice point is not within the active length of the vibratory string so as not to unnaturally distort the tonal qualities of the string. For example, such a hybrid string may be formed by joining a length of Ni—Ti wire to a length of steel wire whereby the steel wire forms the active length of the vibratory string and the Ni—Ti wire comprises an inactive or collaterally active length disposed, for example, between the hitch pin and the bridge of the instrument. In this manner, the Ni—Ti wire portion can be optimally selected and strained to its superelastic state to provide tension regulation of the active string length. Alternatively, if the active length of the vibratory string is to comprise two or more portions of dissimilar wire (ie. the splice point is within the active length), then it is desirable to select and balance the wires so that they have approximately equal elasticity and density per unit length in order to assure pleasant tonal and harmonic qualities.

Figure 5A:
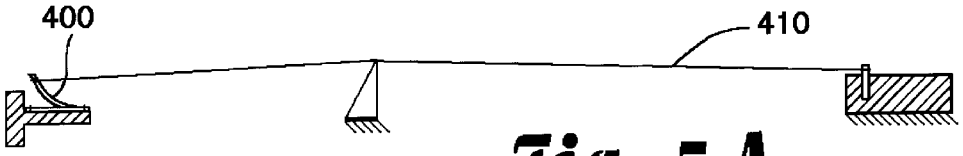
FIGS. 5A–C are schematic diagrams illustrating various string tension regulation elements having features in accordance with he present invention.
Figure 5B:
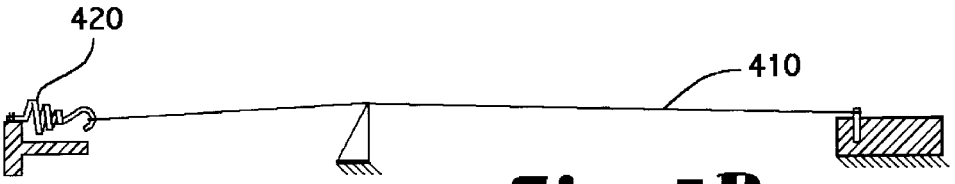
Figure 5C:
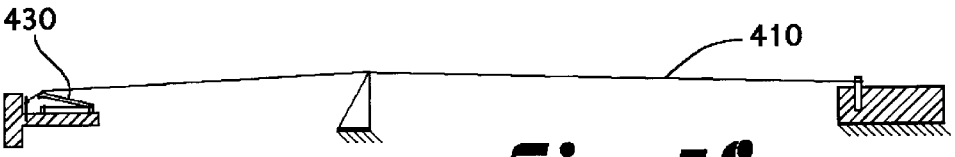

Similarly, tension regulation of a conventional vibratory string may also be accomplished by providing a simple tension regulating element formed of a superelastic alloy material tensioned, compressed or otherwise strained to its superelastic state and being provided in mechanical communication with the vibratory string. Such element may be provided, as illustrated in FIGS. 5A and 5B for example, in the form of a Ni—Ti spring element 400, 420 suitably selected and formed and being secured between the hitch pin or harp of the instrument and the vibratory string 410. Alternatively, such element may comprise a similar spring element 430 suitably selected and formed and being positioned adjacent to and bearing against the tensioned vibratory string preferably along an inactive length 410' thereof. Again, those skilled in the art will recognize that such a tension regulating element being formed of a superelastic material and strained to its superelastic state will provide tension regulation of the active string length 410. The particular size, shape, configuration and location of the tension regulating element 400, 410, 430 is not particularly important, but will be governed by the particular application, the amount of tension on the associated vibratory string and degree of tension regulation desired.

For convenience of description and illustration the improvements disclosed herein have sometimes been described and illustrated in the context of an acoustic piano. However, those skilled in the art will readily recognize that these same improvements may also be employed in a number of other musical instruments having vibratory strings, such as, without limitation, guitars, violins, base, harps, harpsichords and the like. Thus, although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A vibratory string for musical instruments comprising a core formed of at least one wire of an alloy material selected to have superelastic properties at about room temperature, said core being impregnated, coated or wound with a second material comprising a precious or semiprecious metal or alloy thereof.

2. The vibratory string of claim 1 wherein said alloy comprises a Ni—Ti alloy comprising between about 49.0 to 50.7% Ti.

3. The vibratory string of claim 2 wherein said alloy comprises a Ni—Ti alloy comprising between about 49.0 to 49.4% Ti.

4. The vibratory string of claim 1 wherein said alloy comprises a Ni—Ti alloy having a transformation temperature between about 15° C. and −200° C.

5. The vibratory string of claim 1 wherein said precious or semiprecious metal comprises copper, gold or silver or an alloy thereof.

6. A musical instrument strung with a vibratory string comprising a core formed of an alloy material selected to have superelastic properties at about room temperature, said string being tensioned to its superelastic state.

7. A method of stringing a musical instrument comprising the following steps:

providing a vibratory string comprising an alloy material selected to have superelastic properties at about room temperature;

securing a first end of said string to said instrument;

securing a second end of said string to said instrument;

supporting said string on said instrument so as to provide an active length thereof capable of sustained vibration; and tensioning said string to its superelastic state.

8. A musical instrument string comprising a wire formed of an alloy material selected to have superelastic properties at about room temperature.

9. The musical instrument string of claim 8 wherein said wire is strained to its superelastic condition.

10. The musical instrument string of claim 9 wherein said wire comprises a Ni—Ti alloy having a characteristic thermoelastic martensitic phase transformation at a transformation temperature (TT) and wherein said string is tensioned to the point of causing stress-induced crystalline transformation from an austenitic crystalline structure to a martensitic crystalline structure.

11. The musical instrument string of claim 10 wherein said Ni—Ti alloy is selected to have a transformation temperature (TT) between about 15° C. and −200° C.

12. The musical instrument string of claim 11 wherein said Ni—Ti alloy comprises between about 49.0 to 49.4% Ti.

13. The musical instrument string of claim 8 wherein said wire is impregnated, coated or wound with a precious or semiprecious metal or alloy thereof.

14. A method of tuning a musical instrument vibratory string, said string comprising a wire formed of an alloy material selected to have superelastic properties at about room temperature, said method comprising the step of straining said vibratory string to its superelastic state and then further straining said vibratory string until a desired pitch is achieved.

15. A method of stringing a stringed musical instrument, said method comprising the following steps:

selecting a vibratory string comprising one or more wires formed of an alloy material having superelastic properties at about room temperature;

securing a first end of said string to said instrument;

securing a second end of said string to said instrument;

supporting said string on said instrument so as to provide an active length thereof capable of sustained vibration; and tensioning said string to its superelastic state.

16. The method of claim 15 wherein said vibratory string is selected to comprise one or more wires formed of a Ni—Ti alloy having a characteristic thermoelastic martensitic phase transformation at a transformation temperature (TT) below room temperature and wherein said string is tensioned to the point of causing at least some stress-induced crystalline transformation from an austenitic crystalline structure to a martensitic crystalline structure.

17. The method of claim 16 wherein said NI—Ti alloy comprises between about 49.0 to 49.4% Ti.

18. The method of claim 16 wherein said Ni—Ti alloy is selected to have a transformation temperature (TT) between about −100° C. and −200° C.

19. The method of claim 15 comprising the further step of impregnating said vibratory string with a precious or semiprecious metal or alloy thereof.

20. The method of claim 15 comprising the further step of coating said vibratory string with a precious or semiprecious metal or alloy thereof.

21. The method of claim 15 comprising the further step of winding said vibratory string with a precious or semiprecious metal or alloy thereof.

22. A musical instrument vibratory string comprising a Ni—Ti alloy having a characteristic thermoelastic martensitic phase transformation at a transformation temperature (TT) below room temperature and wherein said string is tensioned to the point of causing at least some stress-induced crystalline transformation from an austenitic crystalline structure to a martensitic crystalline structure.

23. A musically tuned vibratory string comprising at least one wire of an alloy material selected to have superelastic properties at about room temperature, said vibratory string being secured and supported so as to have an active length thereof capable of sustained vibration, said vibratory string being tensioned to its superelastic state.

24. The musically tuned vibratory string of claim 23 wherein said alloy material comprises a Ni—Ti alloy having a characteristic thermoelastic martensitic phase transformation at a transformation temperature (TT) and wherein said string is tensioned to the point of causing at least some stress-induced crystalline transformation from an austenitic crystalline structure to a martensitic crystalline structure.

25. The musically tuned vibratory string of claim 24 wherein said Ni—Ti alloy comprises between about 49.0 to 50.7% Ti.

26. The musically tuned vibratory string of claim 25 wherein said Ni—Ti alloy comprises between about 49.0 to 49.4% Ti.

27. The musically tuned vibratory string of claim 24 wherein said Ni—Ti alloy has a transformation temperature between about −100° C. and −200° C.

28. The musically tuned vibratory string of claim 21 wherein said at least one wire is wound with an outer layer of copper, gold or silver wire.

29. The musically tuned vibratory string of claim 23 strung across the harp of an acoustic piano.

30. A vibratory string for a piano or guitar instrument comprising a wire formed of a titanium alloy material selected to have superelastic properties.

31. The vibratory string of claim 30 wherein said titanium alloy material comprises a Ni—Ti alloy having a characteristic martensitic phase transformation.

32. The vibratory string of claim 31 wherein said vibratory string is tensioned to the point of causing at least some stress-induced crystalline transformation from an austenitic crystalline structure to a martensitic crystalline structure.

33. The vibratory string of claim 31 wherein said vibratory string is tensioned to a point below the tension required to cause stress-induced crystalline transformation from an austenitic crystalline structure to a martensitic crystalline structure.

* * * * *